US010465864B2

(12) United States Patent
Leichner

(10) Patent No.: US 10,465,864 B2
(45) Date of Patent: Nov. 5, 2019

(54) LINEAR LED LIGHT HOUSING

(71) Applicant: EcoSense Lighting Inc., Los Angeles, CA (US)

(72) Inventor: Eric S. Leichner, Bordentown, NJ (US)

(73) Assignee: ECOSENSE LIGHTING INC., Los Angeles, CA (US)

( * ) Notice: Subject to any disclaimer, the term of this patent is extended or adjusted under 35 U.S.C. 154(b) by 158 days.

(21) Appl. No.: 15/822,046

(22) Filed: Nov. 24, 2017

(65) Prior Publication Data

US 2018/0087728 A1 Mar. 29, 2018

Related U.S. Application Data

(63) Continuation of application No. 13/653,999, filed on Oct. 17, 2012, now Pat. No. 9,995,444.

(60) Provisional application No. 61/547,786, filed on Oct. 17, 2011.

(51) Int. Cl.

| | |
|---|---|
| ***F21S 2/00*** | (2016.01) |
| ***F21S 8/00*** | (2006.01) |
| ***F21S 8/04*** | (2006.01) |
| ***F21S 8/06*** | (2006.01) |
| ***F21V 17/00*** | (2006.01) |
| ***F21S 4/28*** | (2016.01) |
| *F21V 15/015* | (2006.01) |
| *F21V 21/02* | (2006.01) |
| *F21V 21/112* | (2006.01) |
| *F21V 23/04* | (2006.01) |
| *F21Y 115/10* | (2016.01) |

(52) U.S. Cl.

CPC ..... *F21S 2/005* (2013.01); *F21S 4/28* (2016.01); *F21S 8/036* (2013.01); *F21S 8/04* (2013.01); *F21S 8/061* (2013.01); *F21V 17/002* (2013.01); *F21V 15/015* (2013.01); *F21V 21/025* (2013.01); *F21V 21/112* (2013.01); *F21V 23/04* (2013.01); *F21Y 2115/10* (2016.08)

(58) Field of Classification Search

CPC .... F21S 2/005; F21S 4/28; F21S 8/036; F21S 8/04; F21S 8/061; F21V 17/002

See application file for complete search history.

(56) References Cited

U.S. PATENT DOCUMENTS

2008/0080196 A1* 4/2008 Ruud ..... F21S 2/005 362/373
2008/0244944 A1* 10/2008 Nall ..... G09F 13/04 40/544
2009/0225546 A1* 9/2009 Pearson ..... F21S 2/005 362/249.06
2009/0310354 A1* 12/2009 Zampini, II ..... F21V 15/013 362/235

(Continued)

*Primary Examiner* — Jong-Suk (James) Lee
*Assistant Examiner* — Christopher E Dunay
(74) *Attorney, Agent, or Firm* — Jay M. Brown

(57) ABSTRACT

In embodiments of the present disclosure improved capabilities are described for a modular linear LED lighting system providing a flexible architectural slot lighting system with multiple configurations based on the same base body design with a performance of traditional lighting sources. The linear LED lighting system comprises at least one of a multiple attachment facility, multiple functional compartments, a linear series internal attachment facility, an end cap electrical interconnection facility, an adaptable optic facility, and a dimming facility.

27 Claims, 14 Drawing Sheets

(56) References Cited

U.S. PATENT DOCUMENTS

| | | | | |
|---|---|---|---|---|
| 2013/0272000 | A1* | 10/2013 | Pearson | F21S 2/005 362/362 |
| 2016/0327249 | A1* | 11/2016 | Pearson | F21S 2/005 |
| 2016/0327256 | A1* | 11/2016 | Hall | F21V 23/009 |

* cited by examiner

LINEAR LED LIGHT HOUSING

CROSS-REFERENCE TO RELATED APPLICATIONS

This application claims the benefit of the following provisional application, the entirety of which is hereby incorporated herein by reference: U.S. Provisional Application 61/547,786, filed Oct. 17, 2011. This application is a continuation of U.S. patent application Ser. No. 13/653,999, filed Oct. 17, 2012, the entirety of which is hereby incorporated herein by reference.

BACKGROUND

Field of the Invention

A system and method consistent with the present disclosure broadly relates to LED lighting. More particularly, the present disclosure is consistent with providing an LED lighting facility that is configurable to a variety of applications.

Description of the Related Art

The need for greater efficacy in lighting sources has increased the demand for LED lighting fixtures. However, the use of LEDs in applications that produce luminosity sufficient for room lighting require current control and heat management that challenges the lighting designer. Therefore new an innovative methods and systems for the electrical, mechanical, and thermal design of LED fixtures is needed.

SUMMARY

The present disclosure is a modular linear LED lighting system with an LED light housing providing a flexible architectural slot light system that has multiple configurations based on the same base body design, with various applications that may be created from the common base fixture. The linear LED lighting system may take the place and/or match the performance of a traditional fluorescent light, halogen incandescent light, and like linear architectural fixture types. In embodiments, the function of the linear LED lighting system may combine and/or exceed qualities of traditional sources into a more versatile fixture, with all the performance benefits of LED lighting. In embodiments, the linear LED lighting system may provide for a modular housing configured with removable and/or replaceable optional mounting attachments, such as on multiple sides.

In embodiments, the linear LED lighting system may provide for multiple compartments, wherein the linear LED light housing may be configured with at least two separate internal compartments such as with one for housing and heat sinking an LED set and one for housing and heat sinking LED driver electronics, each of the internal compartments having a unique mounting surface with one for mounting an LED set and one for mounting LED driver electronics, where one of the compartments is an electronics and power compartment for safely housing LED driver electronics and with a raceway for containing wires that traverse the housing while allowing user access to the separate compartment, and the like.

In embodiments, the linear LED lighting system may provide for a linear series internal attachment system. The linear LED light housing may be configured with an open side end exposing a mechanical attachment point while protecting a user from internal electronics, such that a second linear LED light housing with an open side end can be abutted and mechanically secured forming an extended length linear LED light housing. The system may include mechanically securing two linear LED light housings together by abutting their open ends and attaching an internal bracket through a top end of the housings, such as where all exposed electrical components are safely contained in a separated compartment. The system may include a mechanical assembly connection device to hold the two linear LED light housings together during assembly such that the device is temporarily configured to provide a structurally rigid temporary assembly while providing an opening for a user to make the necessary electrical interconnections prior to abutting the housings together for mechanical attachment.

In embodiments, the system may provide an end cap electrical interconnect, such as where the linear LED light housing has an open side end where a quick connect electrical connection is mounted such that another linear LED light housing with a matching open end can be electrically connected, or where an end cap with exiting power wires can be safely connected.

In embodiments, the system may include optics components, such as where the linear LED light housing has at least two compartments, one for safely containing and separating LED driver electrics from another that contains an LED set. The LED set may have a linear configuration generally following the linear nature of the housing and a factory-configured optical package to secure individual optics in relation to each of the LEDs of the LED set.

In embodiments, the system may include the ability to provide dimming functionality, where the linear LED lighting system is adapted to connect to and be dimmed by a conventional AC dimmer.

These and other systems, methods, objects, features, and advantages of the present disclosure will be apparent to those skilled in the art from the following detailed description of the preferred embodiment and the drawings. All documents mentioned herein are hereby incorporated in their entirety by reference.

BRIEF DESCRIPTION OF THE DRAWINGS

The disclosure and the following detailed description of certain embodiments thereof may be understood by reference to the following figures.

DESCRIPTION OF THE PREFERRED EMBODIMENTS

Figure 1:
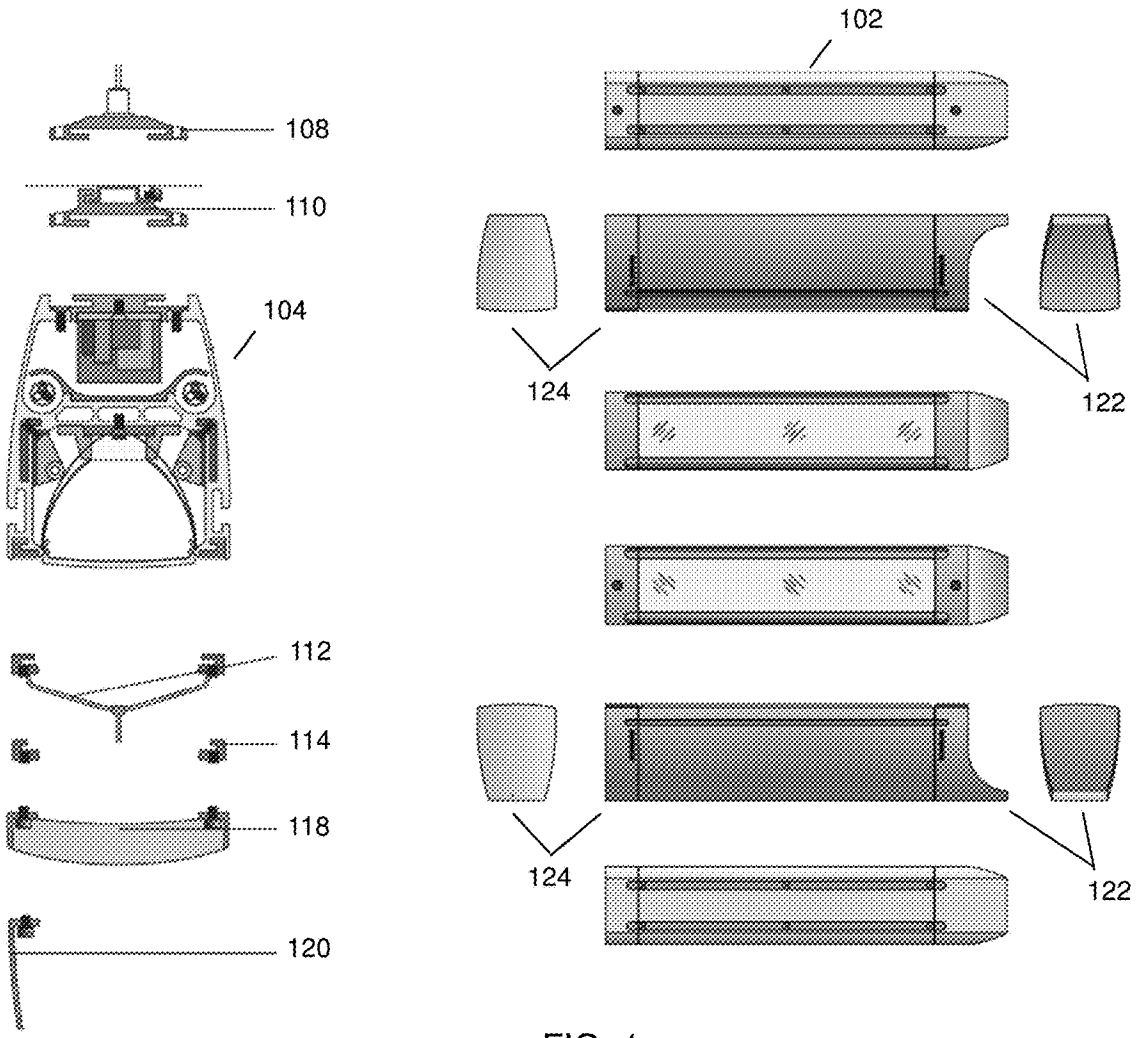
FIG. 1 depicts an assembly view of optional components of the linear LED light housing in an embodiment of the present disclosure.

The present disclosure will now be described in detail by describing various illustrative, non-limiting embodiments thereof with reference to the accompanying drawings. The disclosure may, however, be embodied in many different forms and should not be construed as being limited to the illustrative embodiments set forth herein. Rather, the embodiments are provided so that this disclosure will be thorough and complete, and will fully convey the concept of the disclosure to those skilled in the art. The claims should be consulted to ascertain the true scope of the disclosure.

This illustrative, non-limiting embodiment of the present disclosure is a modular linear LED lighting system with an LED light housing providing a flexible architectural slot light system that has multiple configurations based on the same base body design. The various applications that may be created from the common base fixture include recessed, pendant uplight, pendant downlight, surface mount, and the like, as well as cantilevered and wall-wash light fixtures in many different architectural environments, where modular linear LED lighting housings may be interconnected to form extended linear LED lighting configurations through the attachment of two or more modules.

The linear LED lighting system of the present disclosure may take the place and/or match the performance of a traditional fluorescent light, halogen and incandescent point source lamps, and like linear architectural fixture types. In embodiments, the function of the linear LED lighting system may combine and/or exceed qualities of traditional sources into a more versatile fixture, with all the performance benefits of LED lighting. For example, the linear LED lighting system may provide for the replacement of a traditional non-LED point source fixture where illumination at a distance is required, such as MR16, PAR20, and the like. Application environments for which the linear lighting system may be specified may include an open office, private office, meeting and board rooms, auditoriums, reception areas, corridors, wall washing, library stack lighting, general indirect room lighting, waiting areas, court rooms, high ceiling atriums, large volume spaces, and the like.

The linear LED lighting system may provide for a modular, multiple attachment system, where the Linear LED light housing may be configured with removable and replaceable optional mounting attachments on two or more sides. Installation and mounting may include a T-slot along the top of a common spine of the modular housing to accept fittings for surface attachment, aircraft cables, stem tubes, and the like for downlight pendant mounting. The fixture may be capable of indirect pendant mounting from the same continuous screw slots on the bottom face as where the optical lenses and louvers mount. Recessed and cantilevered mounting option fittings may slide into T-slots on both sides of the fixture housing. In embodiments, slots may be integrated into the fixture so that they become decorative elements, and also allow for recessed and/or hidden setscrews to allow for the seamless joining of fixture body sections. Recessed mounting accessory options may include a trim-less mud flange, types of lay-in grid attachments, and the like. In embodiments, the base modular fixture may have an aluminum housing that may serve as the heat sink, a polycarbonate lens with a gasket, an integral driver with electrical quick disconnects between module lengths, and the like. The modules may be manufactured in certain lengths, such as two foot, three foot, four foot, eight foot, twelve foot, and the like. The base modular fixture may have methods to accept various lensing and visual shielding offered as accessories. The fixture rating may be for indoor, outdoor, damp locations, and the like, and have an ingress protection rating, such as IP20, IP40, IP44, and the like.

The linear LED lighting system may provide for a housing with multiple compartments. For instance, the linear LED light housing may be configured with at least two separate internal compartments, such as one for housing and heat sinking an LED set and one for housing and heat sinking LED driver electronics. The linear LED light housing may be configured with at least two separate internal compartments, each of the internal compartments having a unique mounting surface, such as one for mounting an LED set and one for mounting LED driver electronics. The linear LED light housing may be configured with at least two separate internal compartments, such as where one of the compartments is an electronics and power compartment for safely housing LED driver electronics and a separate raceway for containing wires that traverse the housing while allowing user access to the separate compartment after the fixture has been installed.

The base fixture construction may incorporate methods for seamlessly joining the modules into continuous linear lengths, thus creating a linear series internal attachment system. For instance, the fixture body may have universal accessory mounting "T" slots that become an integral part of the aesthetic of the fixture when not being utilized. The linear LED light housing may be configured with an open side end exposing a mechanical attachment point while protecting a user from internal electronics, such that a second linear LED light housing with an open side end can be abutted and mechanically secured forming an extended length linear LED light housing. Abutting their open ends and attaching an internal bracket through a top end of the housings, where all exposed electrical components are safely contained in a separated compartment, may accomplish mechanically securing two linear LED light housings. Mounting accessories may determine how the base fixture is configured and applied in each application. The accessories may be sold separately on an as-needed basis to be easily installed by a contractor and inventoried according to the fixture forecasting. Accessories may coordinate with the base extrusion method of fixing the parts seamlessly together. The recessed mounting options may include trims that have air-handling functions for return air plenums.

The system may include a mechanical assembly connection device to hold the two linear LED light housings together during assembly such that the device is temporarily configured to provide a structurally rigid temporary assembly while providing an opening for a user to make the necessary electrical interconnections prior to abutting the housings together for mechanical attachment. For example, a user may wish to assemble a multi-module LED linear light assembly, where the assembly is being mounted on a wall or suspended from the ceiling. To facilitate the assembly, the user may be able to structurally secure the modules together with a mechanical assembly connection device between each pair of modules. In this way, the user may construct a structurally rigid lighting assembly that leaves spaces for subsequent electrical interconnection. Once the electrical interconnections are made, the user may then abut the modules and make mechanical connections. This may allow a single person to assemble the lighting system. In embodiments, the mechanical assembly connection device may be mounted on the housing such that it is always available for use in separating two modules a part while maintaining an overall structural integrity. The mechanical assembly connection device may be mounted internal to the housing such that when two modules are abutted together the mechanical assembly connection device is not visible. In embodiments, the mechanical assembly connection device may be attached and removed as needed.

The fixture endcaps may have multiple functions, such as sealing the ends of the fixture in both recessed and exposed applications, provide the point of entry for power cables into the fixture, act as the junction box, and the like. Endcaps may have the capability to be opened from below for inspections by electrical inspectors in inaccessible hard ceilings. The endcaps may have the option to become decorative elements in exposed pendant, surface, cantilever, and the like applications, and as such have the ability to make the fixture a sculptural element in a space if so desired. The endcap may provide for electrical interconnection, such as a linear LED light housing with an open side end where a quick-connect electrical connection may be mounted such that another linear LED light housing with a matching open end may be electrically connected or where an end cap with exiting power wires may be safely connected. In embodiments, there may be multiple endcap configurations for the various applications.

The linear LED lighting system may provide for various LED light engine capabilities, such as a white light LED in warm 2700K, 3000K, cool 4000K, or for alternate correlated color temperatures (CCT), and the like. The system may provide for dimming control, where the dimming control may be a leading edge incandescent TRIAC, trailing edge ELV compatible, 277V 0-10V dimming, and the like. The linear LED lighting system may be adapted to connect to and dimmed by a conventional AC dimmer. Dimming down to less than 1% on incandescent TRIAC and ELV compatible dimmers may include a wall box, panel, and other BMS and daylight systems. The driver may have quick-disconnects enclosed within the housing to continue power between fixture lengths. The driver board may be replaceable and have quick disconnect connectors to each LED board and the main power. The housing may incorporate mechanical devices to facilitate the field replacement of driver boards. A wiring method to include an emergency power circuit may be integral to each fixture body length. In embodiments, for 277V, a dimmable 0-10V data cable and connector(s) may be incorporated into each fixture body length.

In embodiments, there may be multiple illumination output levels, such as a low output (e.g. to equal the lumens of a typical single T8 or T5 lamp in cross-section), a high output (e.g. to equal the lumens of either two (2) T8, two (2) T5, or a single T5HO in cross-section), and the like. In an example, a low power module may provide for 600 lumens at 2700K/3000K, 700 lumens at 4000K, 9 Watts/LF, 65 lumens/Watt, and the like. A high power module may provide for 850 lumens at 2700K/3000K, 950 lumens at 4000K, 13 Watts/LF, 65 lumens/Watt, and the like. In embodiments, a two-tier output level may match the performance and intensity of a linear incandescent halogen point source (e.g. MR-16), linear picture light, wall graze fixture with rectilinear spread lens, and the like.

In embodiments, the linear LED lighting system may include an optics package, where the LED lighting housing has at least two compartments, with one of the compartments for safely containing and separating LED driver electrics from another compartment containing an LED set. The LED set may have a linear configuration generally following the linear nature of the housing. In embodiments, the optics package may be factory installed, user removable and replaceable, and the like, to secure individual optics in relation to each of the LEDs of the LED set. In embodiments, the base fixture may include a clear polycarbonate lens to shield direct contact with the LEDs, and to protect the internal base optic. Each base fixture may come with this narrow angle, shadow-less clear lens.

The optical and shielding accessories for the linear LED lighting system may include optical light shaping lenses, film and diffusers, louver systems, and the like. The base fixture may include a clear polycarbonate lens to shield direct contact with the LEDs in the fluorescent performance option, and to shield the internal base optic in the point source performance option. The optical lenses may be in addition to a base clear polycarbonate lens and have the ability to shape the light distribution into specific angles to cover a multitude of applications. The overall length of the optical lenses may coordinate with the lengths of the fixture extrusions. The accessory optical lens may consist of a polycarbonate lens that attaches to the fixture to accept lengths of thin film from rolls to be securely fastened by pressure without need for hardware to keep the two together. The tooled accessory lens lengths may accept various film distributions.

The linear LED lighting system may include a plurality of accessory components for mounting, joining modules, shielding, optical lenses, sensors, endcaps, and the like. Mounting accessories may include a pendant uplight aircraft cable with Y-connector and attachments, a pendant downlight aircraft cable with T-slot connector, pendant aircraft cable powered and non-powered canopies, cantilever wall canopy and multiple length stems and adjustable knuckle for aiming the fixture towards or away form the wall, surface bracket with T-slot connector, recessed lay-in grid, recessed air handling trim attachment (e.g. integral to recessed attachments, a second line of all recessed mounting methods), recessed tie back attachment (e.g. stem or wire) with T-slot connector, and the like. Section joiners may include a 90° corner, a T-connector, an X-connector, and the like. Shielding may include a parabolic louver, straight blade louver, and the like. Optical lenses may include 10°, 20°, 40°, 60°, 80°, 10°×60°, very wide optic for uplight pendent configuration, and the like. Sensors may include a daylight sensor, motion sensor, a smoke detector, a temperature sensor, and the like. Endcaps may include a recessed endcap with power feed, recessed endcap with power feed and data feed, recessed endcap with no power or data, pendant uplight endcap with power feed, pendant uplight endcap with power feed and data, pendant endcap with no power or data, decorative endcaps, and the like.

Referring to FIG. 1, an embodiment of the linear LED lighting facility is presented, where views of the external modular housing 102 are shown, including a standard endcap 122 and decorative endcap 124 utilized in closing off the end of the housing 102 when not connected to another housing in a linear lighting assembly. An assembled fixture body cross-section 104 is also shown, with internal components depicted. The fixture body 104 may then be mounted through attachment with a plurality of different mounting components, including a pendant downlight aircraft cable mounting attachment 108 (sliding into the T-slot on the top cover of the fixture body 104), a surface mounting attachment 110 (sliding into the T-slot on the top cover of the fixture body 104), a pendant uplight aircraft cable mounting attachment 112 (shown upside down to maintain relationship with the fixture body 104), and the like. Also shown is a sliding accessory mounting insert for louvers and shielding 114, a louver accessory 118, and a side shielding/upper wall wash reflector accessory 120.

Figure 2:
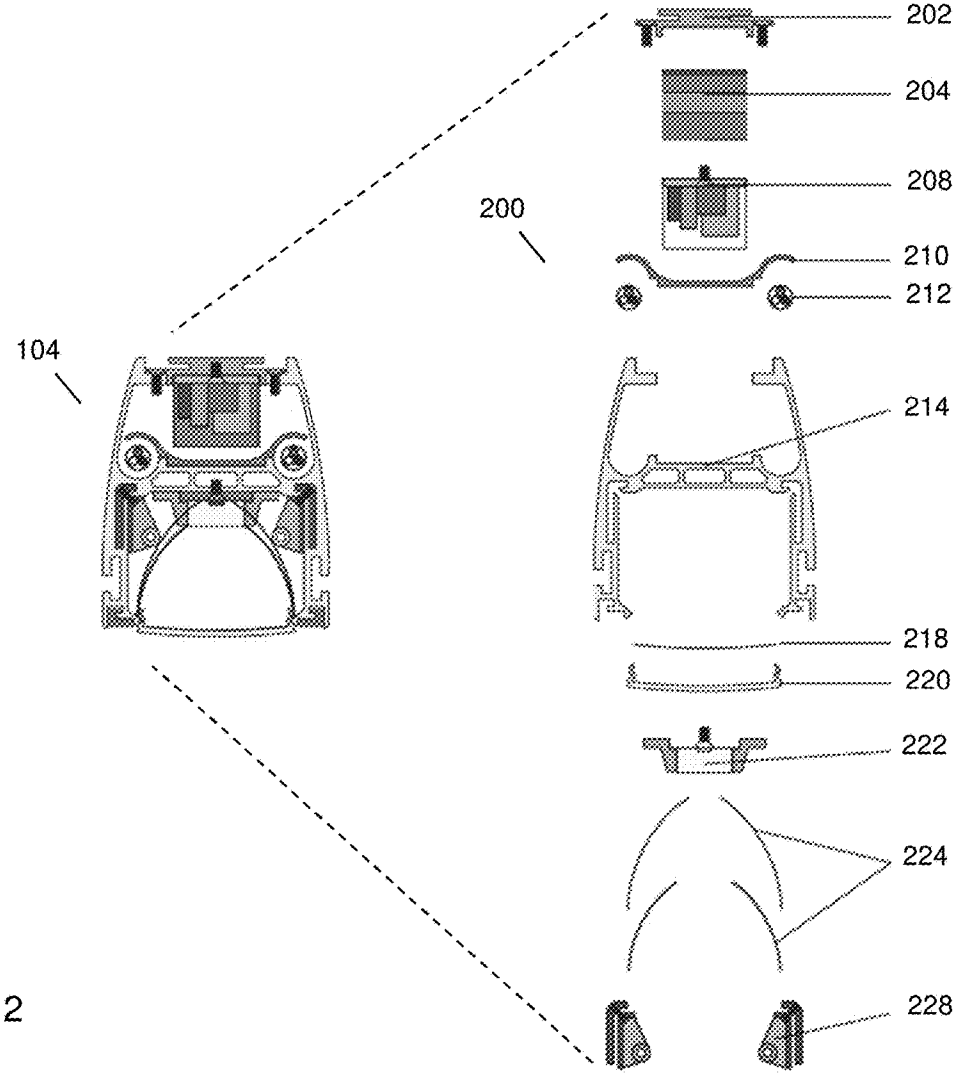
FIG. 2 depicts an exploded cross-sectional view of the linear LED light housing in an embodiment of the present disclosure.

Referring to FIG. 2, the assembled fixture body cross-section 104 is presented with an exploded view of its internal components 200. The driver cover 202 may be removable for driver replacement or internal service of cables, and may include a T-slot for mounting. The LED driver 208 is depicted as a standard LED driver mounted to a driver cover. An optional LED driver 204 (e.g. high output LED driver) is also shown, meant to replace the standard LED driver for higher power applications. An internal wire-way cable harness 210 may isolate and secure cables 212, where the cables 212 may include normal and emergency power, as well as 0-10V control wiring for 277V power, and DALI for 240V power. The main body aluminum extrusion 214 accepts and organizes the various internal components, including the LED, electrical, joining, mounting, optics, shielding options for the fixture, and the like. A frosted or optical film 218 is shown that may be pressure fit into the polycarbonate lens 220. The polycarbonate lens 220 may be removable, snap-in to the fixture body, and may accept the frosted or optical film strip 218 (extruded vs. injection). The secondary optic lens holder 222 may be a factory installable series of collimators to shape the light into a narrow beam for use with optical film. High reflectance internal reflector 224 may direct light out of the fixture and increase efficiencies, and create a bright interior that will reduce the visual contrast of the LED within the fixture and also help to assist with light leak at the seams. Finally, the fixture joining brackets 228 may align the vertical and horizontal axis of the end-to-end connection as well as pull the extrusions tightly together.

Figure 3:
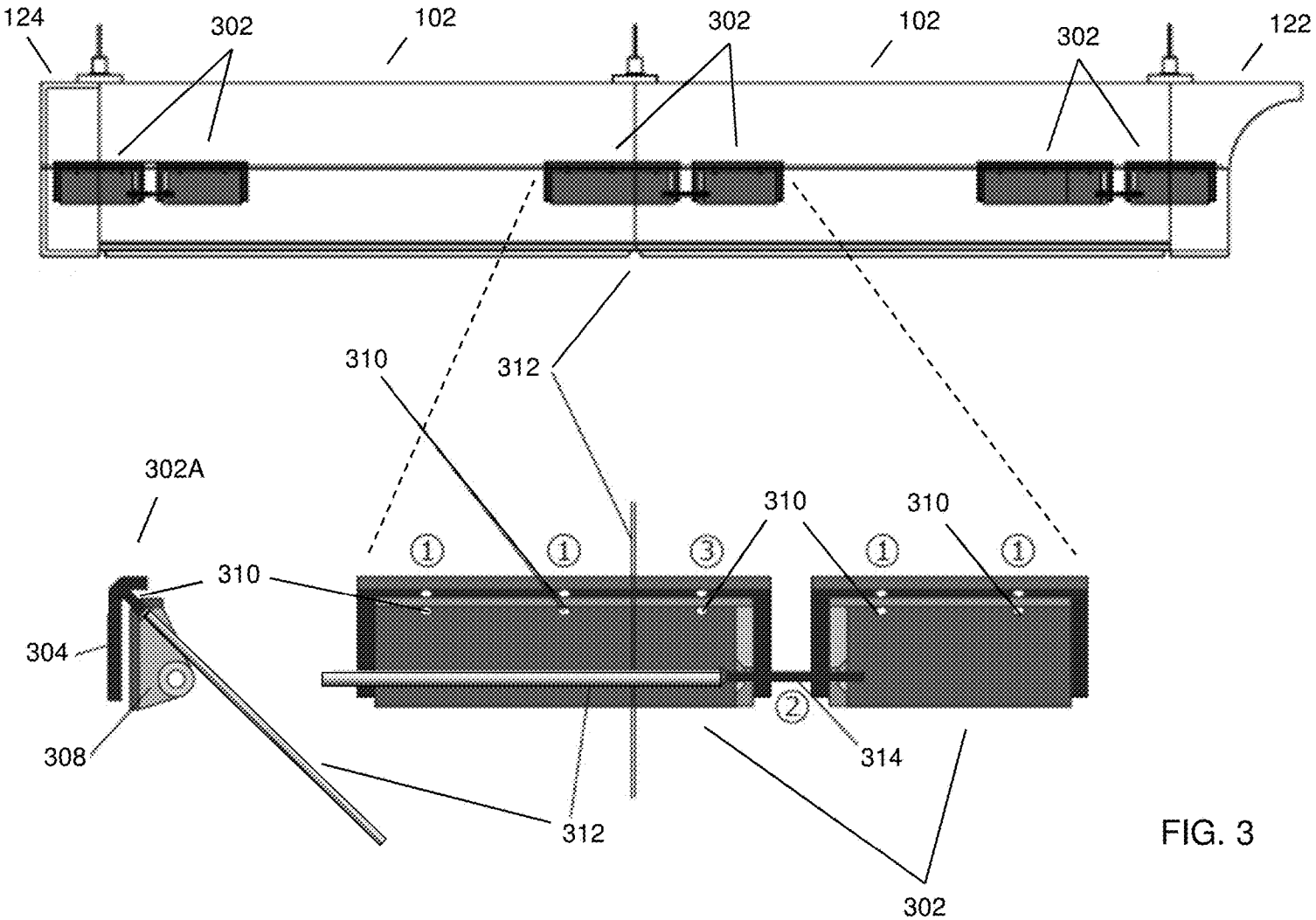
FIG. 3 depicts a mechanical connection scheme for multiple linear LED light housings in an embodiment of the present disclosure.

Referring to FIG. 3, two housings 102 are shown connected together with joining bracket assemblies 302. A joining bracket assembly 302 is also shown connecting the endcaps 122, 124 to the housings 102. In embodiments, the joining bracket assembly 302 may consist of several components, such as an internal joining bracket 304 and a front joining bracket 308, and attached with an angled setscrew 310 with an Allen wrench 312. The angled setscrews 310 may pull the internal 304 and front joining brackets 308 together, sandwiching the main extrusion on both the planes, and thus aligning them. In an example of the assembly, (1) the joining brackets may be inserted into the main extrusion(s), lined up as shown on the extrusion seam 312, and then tightened with the setscrews. (2) The key fastener 314 may then be inserted through the bracket flanges, and tightened until the extrusions are flush. (3) Then the final set screw that is located on the opposite side of the extrusion seam 312 may be used to lock the vertical and horizontal alignment of the seam 312.

Figure 4:
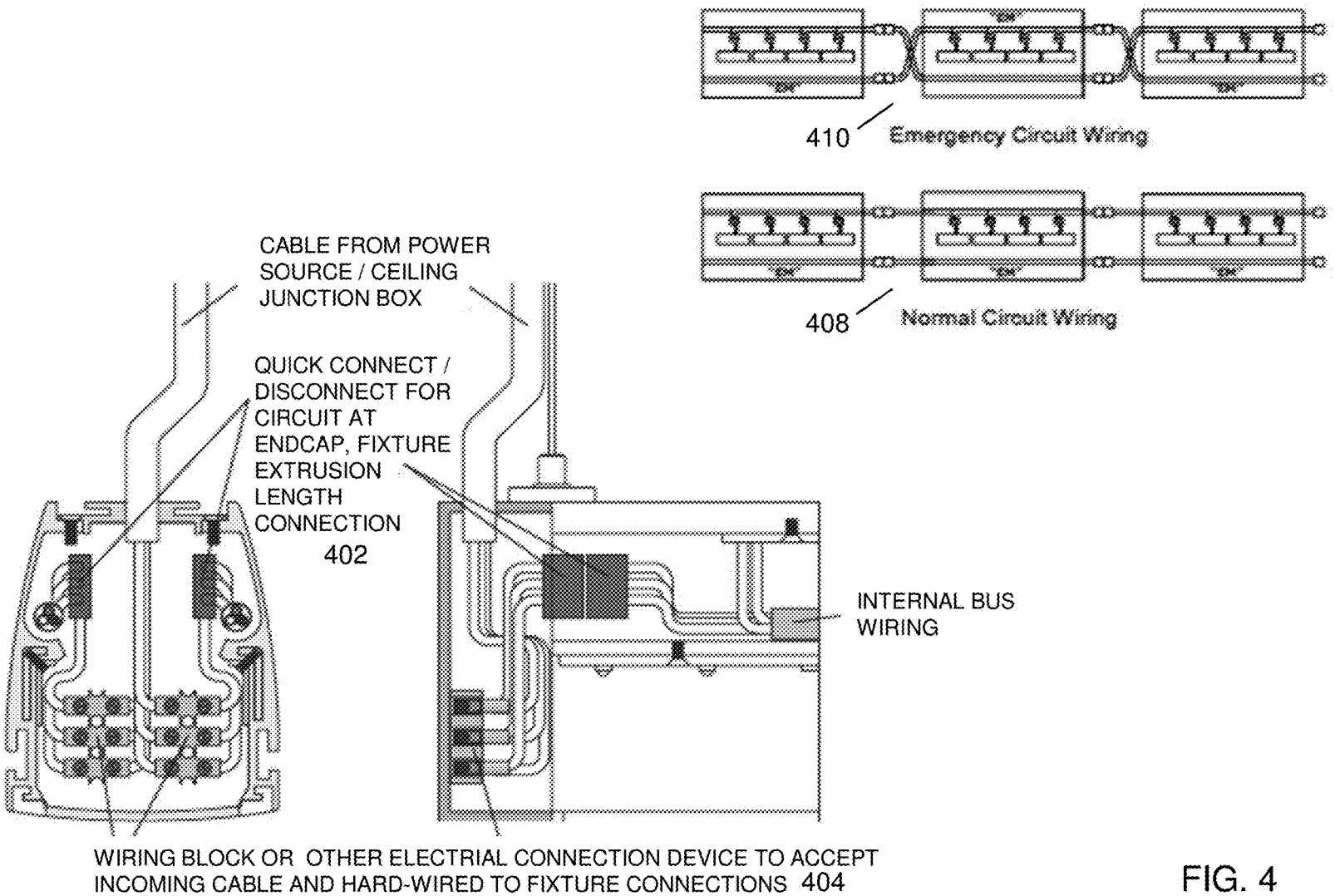
FIG. 4 depicts an electrical connection scheme for the linear LED light housing in an embodiment of the present disclosure.

Referring to FIG. 4, an embodiment scheme for running internal wiring is presented, such as including both 'normal' power wiring 408 and 'emergency' power wiring 410. Typical normal power wiring 408 may be power from non-emergency building power circuits that are then wired to the driver and LED boards. Typical emergency power wiring 410 may be a second circuit that bypasses the normal power driver(s) except for the fixture sections labeled for emergency power. In embodiments, there may be quick connect-disconnects 402 for circuits at the endcap, at the fixture extrusion length connection, and the like. A wiring block 404 or other electrical connection device may also be available to accept incoming cable and/or hard-wired for fixture connections.

Figure 5:
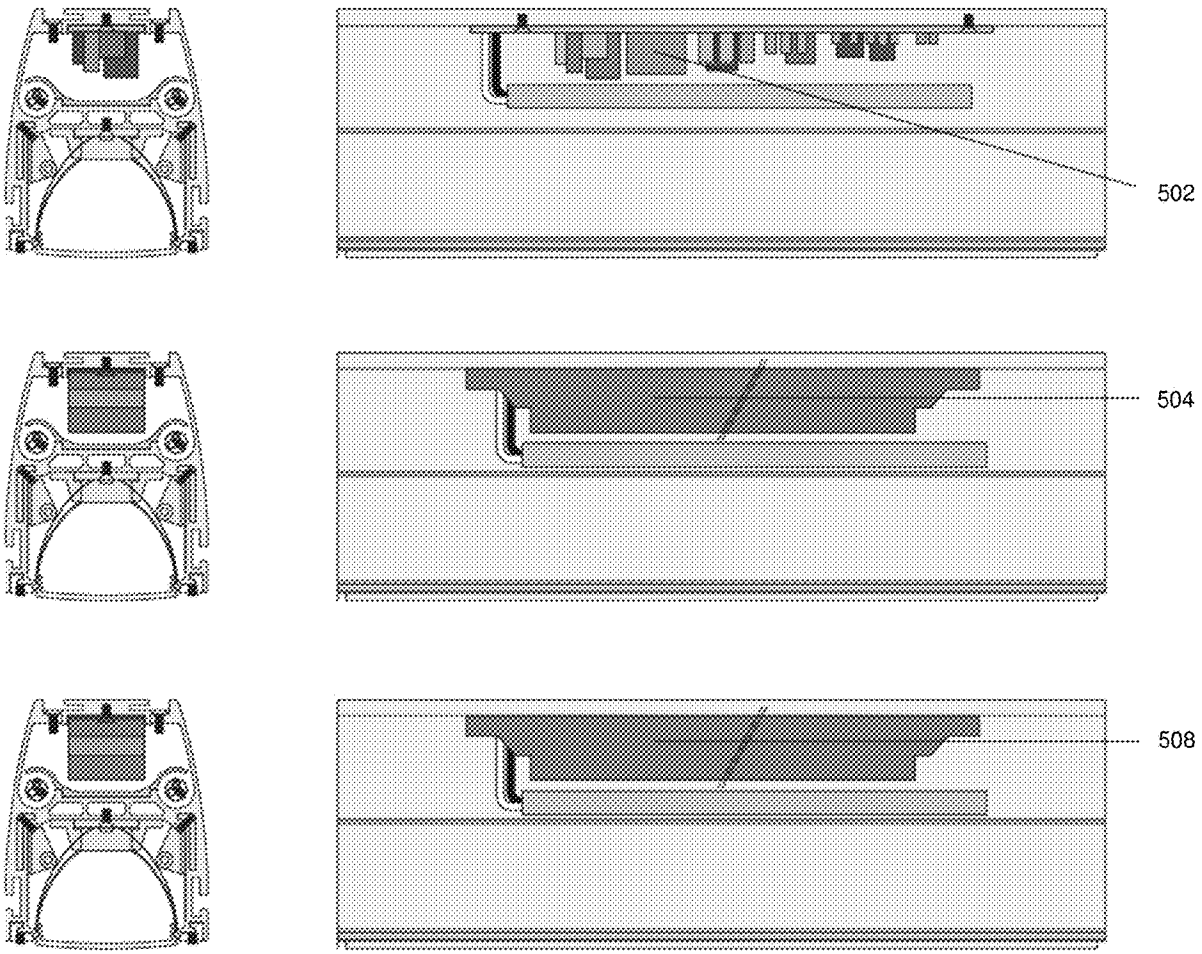
FIG. 5 depicts embodiments of LED driver configurations for the linear LED light housing.

Referring to FIG. 5, different LED driver options may be available for the linear LED lighting system, such as a standard LED driver 502, an optional higher power LED driver 504, an optional higher voltage (240V vs. 120V) source LED driver 508, a third party driver such as a Lutron Hi-Lume LED driver, and the like.

Figure 6:
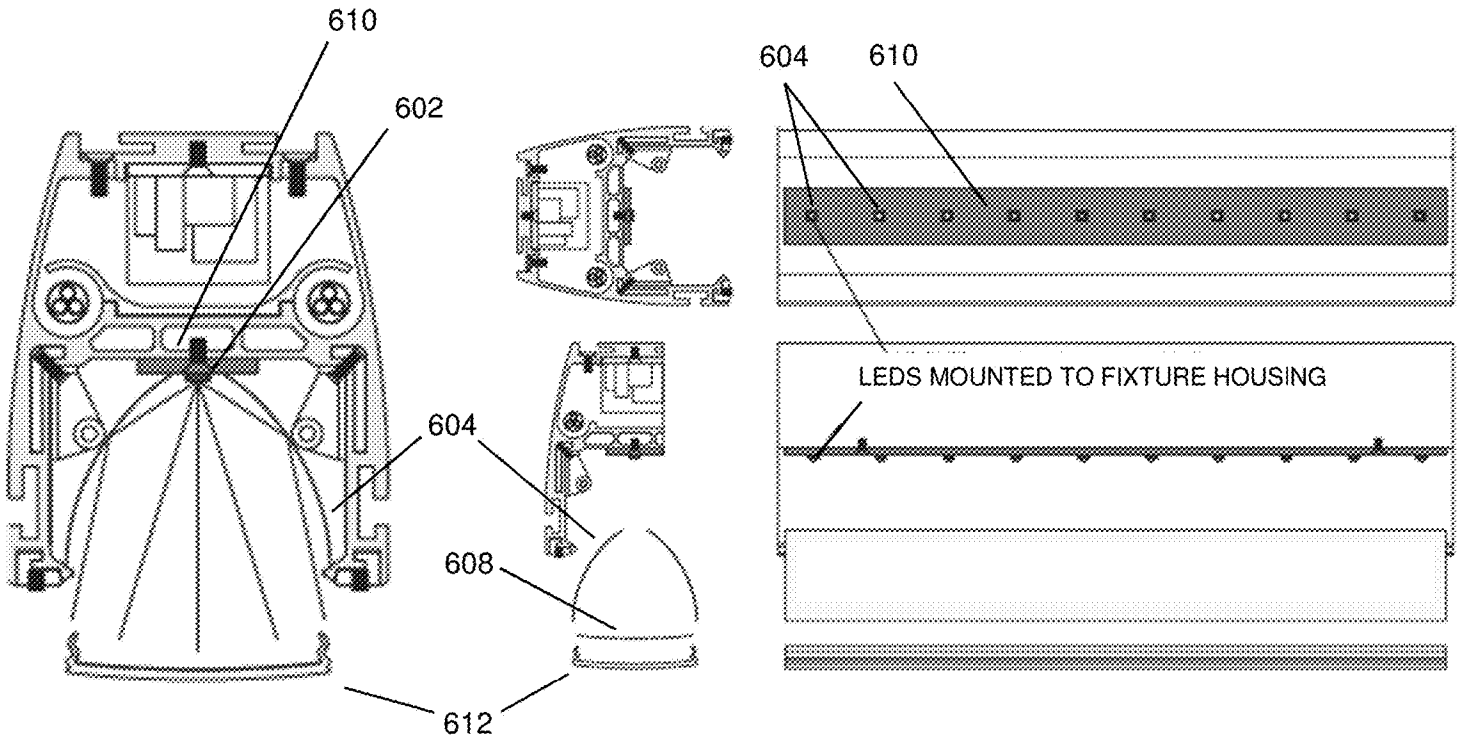
FIG. 6 depicts an optical configuration of the linear LED light housing to mimic a traditional florescent source fixture in an embodiment of the present disclosure.
Figure 7:
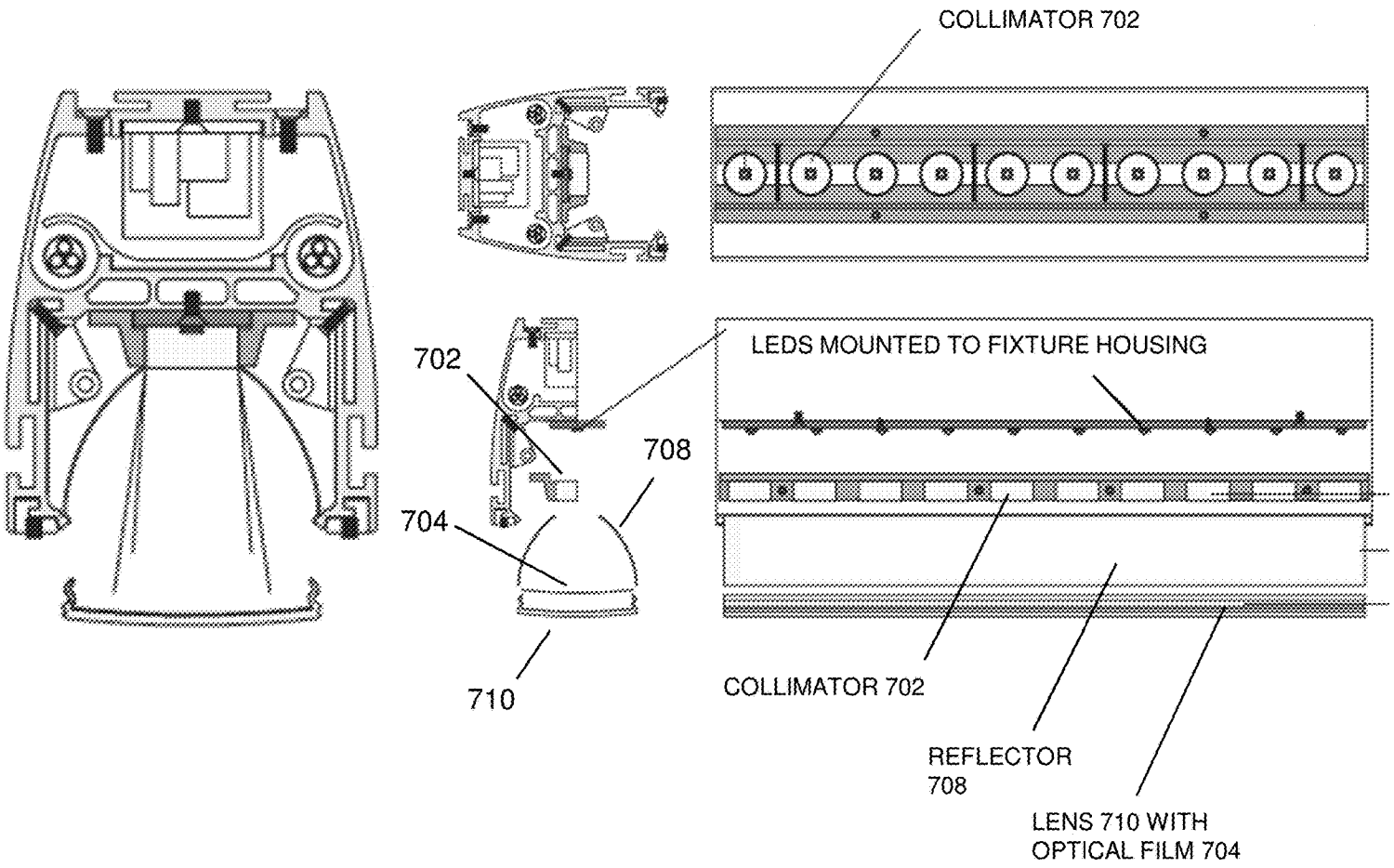
FIG. 7 depicts an optical configuration of the linear LED light housing to mimic a traditional point source fixture in an embodiment of the present disclosure.

In embodiments, there may be different optical configurations available, such as to simulate a fluorescent light, a point source, and the like. For example, FIG. 6 depicts a bare, full distribution LED 602 in combination with a white reflector 604 and frosted film 608 to allow the LED to mimic a traditional fluorescent source fixture. LEDs on a board may be mounted to the fixture housing extrusion 610 as part of the base fixture. In this configuration, secondary optics may not be required. The white reflector 604 in this configuration may assist in directing the light towards the aperture and frosted film 608. This may increase efficiencies while minimizing contrast between the LED and the internal housing. The frosted film 608 in the lens 612 may then diffuse the light similarly to that of a fluorescent fixture. In another example, FIG. 7 depicts an assembly with factory installed collimator 702 optics in combination with an optical film 704 to provide LED lighting to mimic a traditional point source. To achieve point source performance, a narrow beam secondary optic collimator 702 assembly is shown installed on the base fixture. The white reflector 708 assists in directing any stray and reflected light towards the aperture and optical film 704. This may increase efficiencies while also minimizing contrast between the LED and the internal housing. The optical film 704 in the lens 710 may be used to shape the narrow beam into various distributions.

Figure 8:
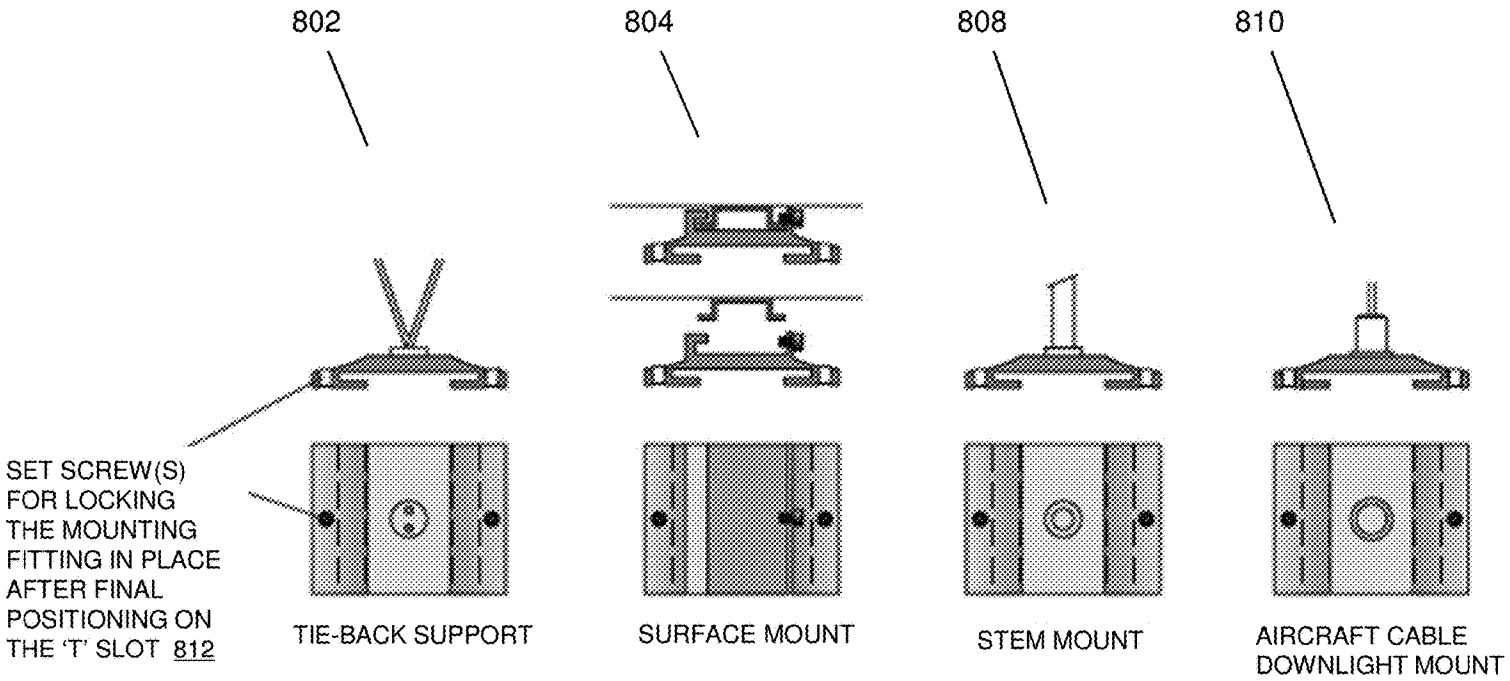
FIG. 8 depicts optional mounting connections for the linear LED light housing in embodiments of the present disclosure.
Figure 9:
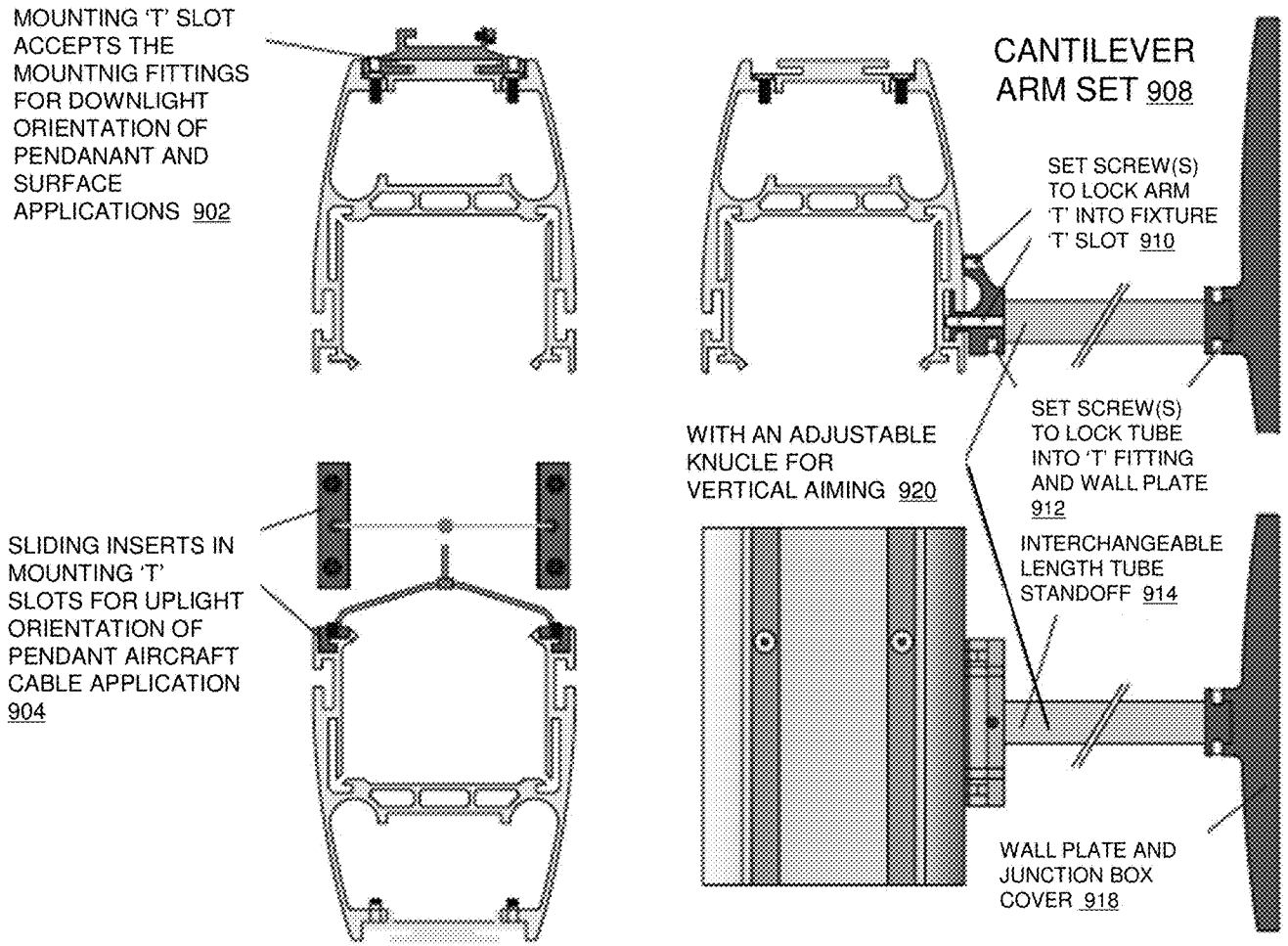
FIG. 9 depicts optional mounting configurations for the linear LED light housing in embodiments of the present disclosure.

FIGS. 8 and 9 depict various embodiment mounting components and configurations, such as for an aircraft cable uplight configuration, an aircraft cable downlight configuration, stem mount, surface mount, cantilever arm mount, and the like. FIG. 8 shows embodiments for top and side views of an embodiment tieback support 802, a surface mount 804, a stem mount 808, and an aircraft cable downlight mount 810. Each view also indicates a potential setscrew position(s) 812 for locking the mounting fitting in place after final positioning on a 'T' slot. FIG. 9 depicts a mounting 'T' slot for accepting the mounting fittings for a downlight orientation of a pendent and surface application 902, and a sliding insert in mounting 'T' slots for uplight orientation of a pendant aircraft cable application 904. Side and top views of a cantilever arm set 908 is shown, including set screws to lock the arm 'T' into a fixture 'T' slot 910, set screws to lock a tube into a 'T' fitting and wall plate 912, an interchangeable length tube standoff 914, a wall plate and junction box cover 918, and a with an adjustable knuckle for vertical aiming 920.

Figure 10:
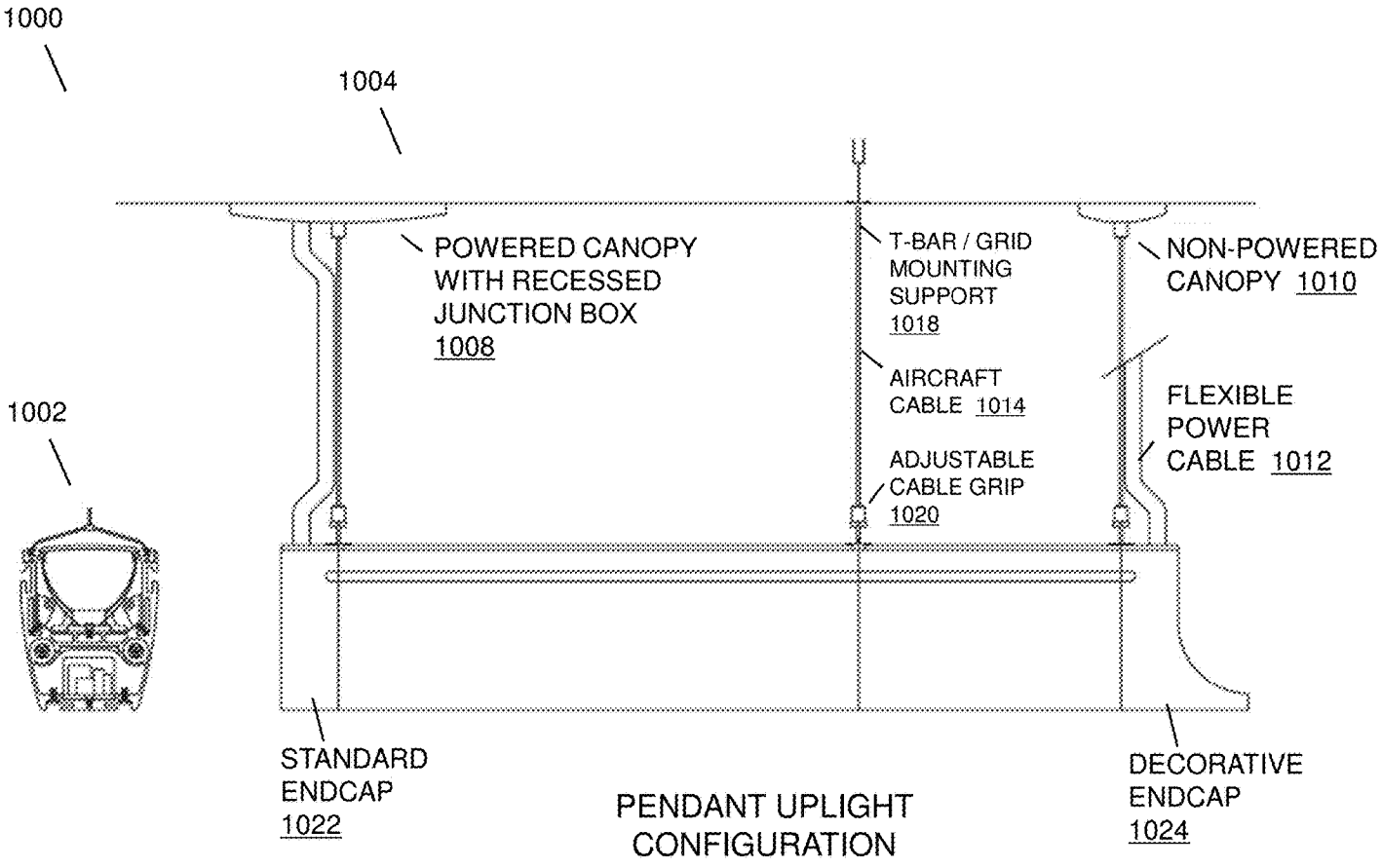
FIG. 10 depicts a pendant up-light mounting configuration for the linear LED light housing in an embodiment of the present disclosure.

FIG. 10 depicts an end 1002 and side view 1004 of an embodiment pendant uplight configuration 1000, showing a single end-capped fixture with a powered canopy with recessed junction box 1008, a non-powered canopy 1010, a flexible power cable 1012, and supporting aircraft cables 1014 with T-bar grid mounting support 1018 and adjustable cable grip 1020. In embodiments, the configuration may use a plurality of different endcaps, such as a standard endcap 1022 and decorative endcap 1024.

Figure 11:
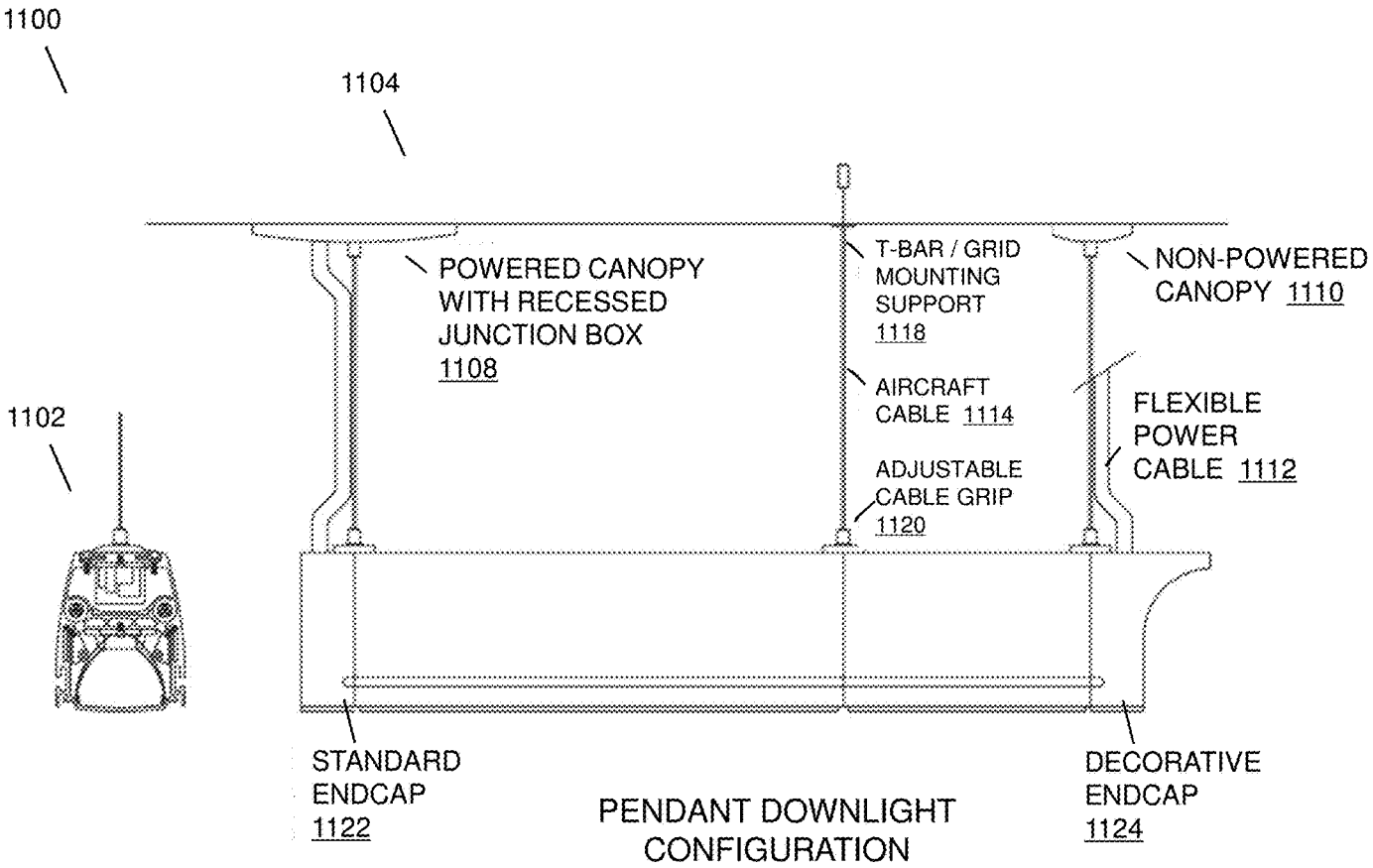
FIG. 11 depicts a pendant down-light mounting configuration for the linear LED light housing in an embodiment of the present disclosure.

FIG. 11 depicts an end 1102 and side view 1104 of an embodiment pendant downlight configuration 1100, showing a single end-capped fixture with a powered canopy with recessed junction box 1108, a non-powered canopy 1110, a flexible power cable 1112, and supporting aircraft cables 1114 with T-bar grid mounting support 1118 and adjustable cable grip 1120. In embodiments, the configuration may use a plurality of different endcaps, such as a standard endcap 1122 and decorative endcap 1124.

Figure 12:
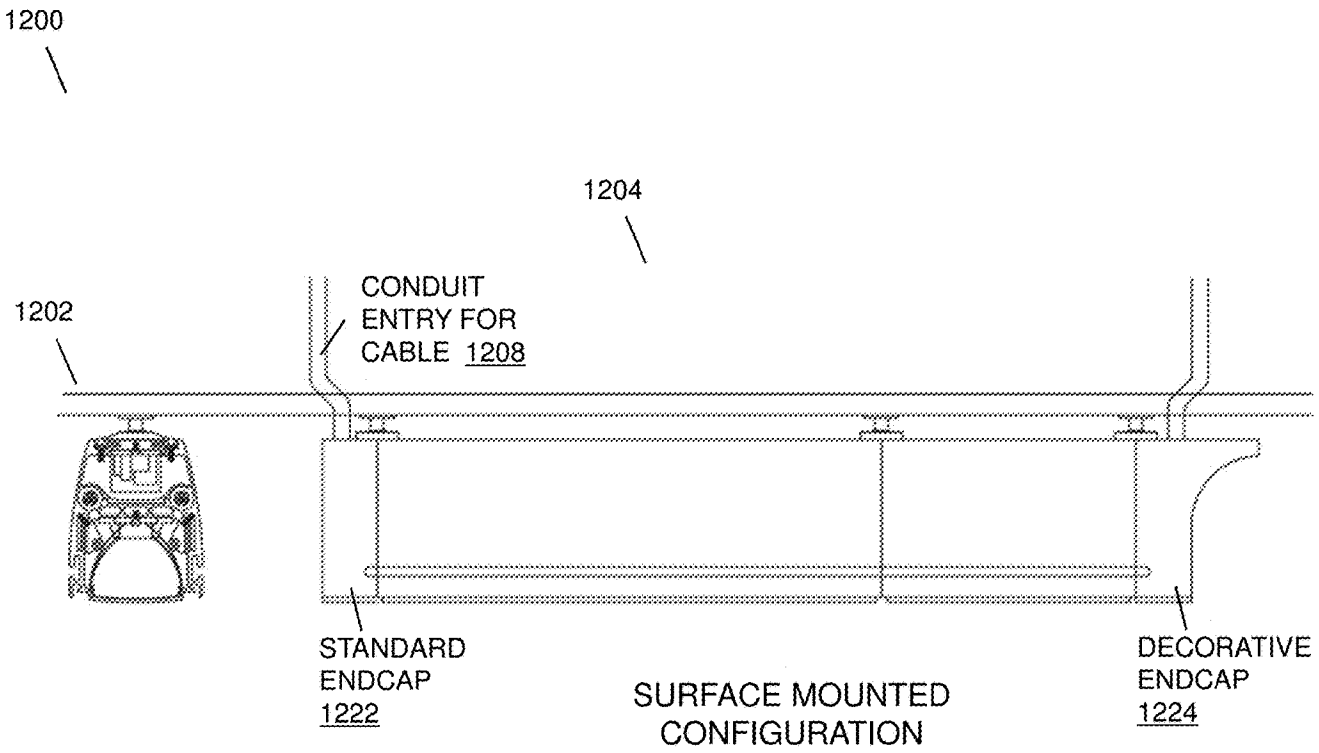
FIG. 12 depicts a surface-mounted configuration for the linear LED light housing in an embodiment of the present disclosure.

FIG. 12 depicts an end 1202 and side view 1204 of a surface mounted configuration 1200, with conduit entry for the cable 1208. In embodiments, the configuration may use a plurality of different endcaps, such as a standard endcap 1222 and decorative endcap 1224.

Figure 13:
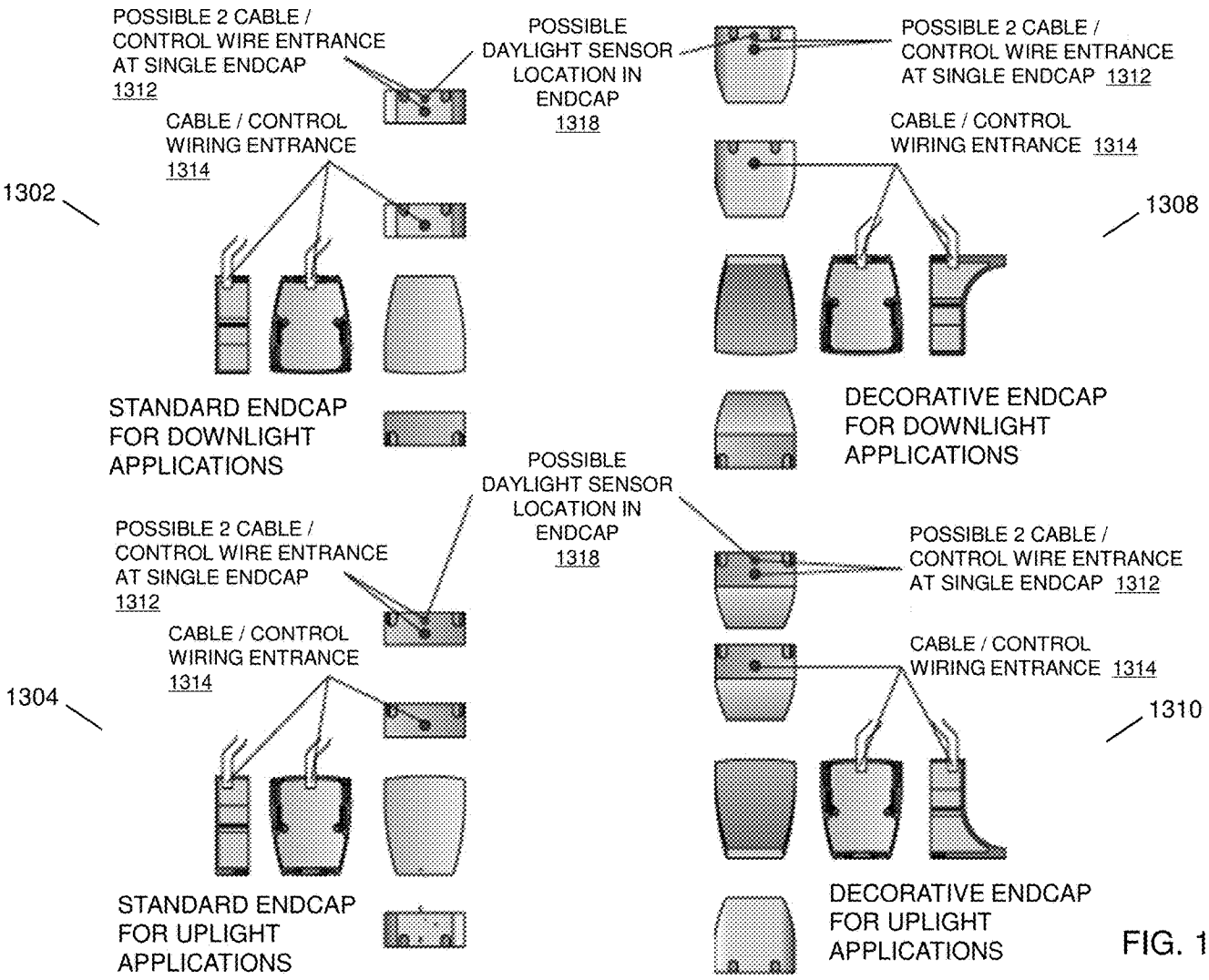
FIG. 13 depicts optional external configuration elements for the linear LED light housing in an embodiment of the present disclosure.

Referring to FIG. 13, the linear LED lighting facility may include a plurality of different endcaps to accommodate the various application configurations, such as a standard endcap for a downlight application 1302, a standard endcap for uplight applications 1304, a decorative endcap for downlight applications 1308, a decorative endcap for uplight applications 1310, and the like. Each of the depicted embodiment configurations 1302, 1304, 1308, 1310 also show possible two-cable and control wire entrances at a single endcap 1312, a cable and control wiring entrance 1314, possible daylight sensor location in the endcap 1318, and the like. In embodiments, all holes in an endcap may be a secondary process to maintain a single set of tooling for the plurality of endcaps, such as for a standard and decorative endcaps.

Figure 14:
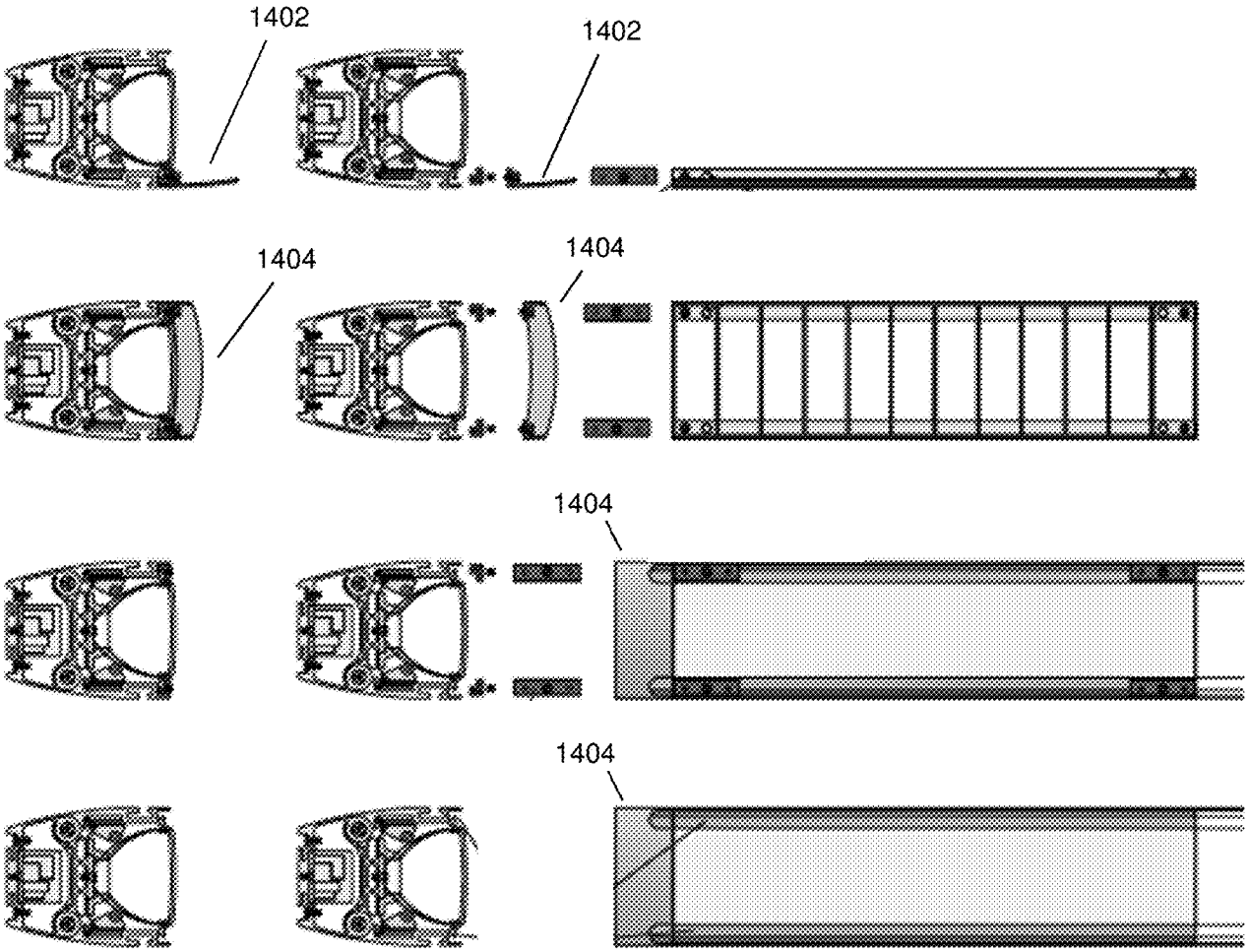
FIG. 14 depicts optional external shielding configurations for linear LED light housing in an embodiment of the present disclosure.

Referring to FIG. 14, the linear LED lighting facility may include a plurality of light shielding options, such as with louvers 1402, side shield(s) 1404, and the like. In an example of how to attach a shield, (1) a sliding mounting may be inserted into the end of the fixture extrusion and loosely locked by a setscrew. (2) The louver/shield may be attached to the inserts, and secured with cap head screws in the outer through-hole(s) of the shielding and the side threaded hole of the insert. (3) The center set screw of the mounting insert may then be adjusted through the inner through-holes of the shielding attachment. Through this method, the insert may be able to slide in the T-slot while fastened to the shielding before being locked into final position.

While the disclosure has been described in connection with certain preferred embodiments, other embodiments would be understood by one of ordinary skill in the art and are encompassed herein.

All documents referenced herein are hereby incorporated by reference.

What is claimed is:

1. A modular linear LED lighting system, comprising:

a linear LED light housing module;

a linear series internal mechanical attachment within the linear LED light housing module, wherein the linear LED light housing module is configured with at least one open side end exposing a mechanical attachment point while isolating a user from internal electronics for abutting and mechanically securing a second linear LED light housing module to form an extended length linear LED light housing modular assembly; and a mechanical assembly connection device to hold the linear LED light housing module and the second linear LED light housing module together during assembly of the extended length linear LED light housing modular assembly, such that when the mechanical assembly connection device is in place in a first configuration between the two housing modules there is a space between the two housing modules to facilitate electrical interconnection while maintaining a structurally rigid temporary assembly.

2. The modular linear LED lighting system of claim 1, wherein the linear LED light housing module is configured with removable and replaceable mounting attachments on at least two sides of the housing for mounting the linear LED light housing module.

3. The lighting system of claim 2, wherein the mounting attachments facilitate a wall mounting.

4. The lighting system of claim 2, wherein the mounting attachments facilitate a suspended attachment to a ceiling.

5. The lighting system of claim 1, wherein once the electrical interconnection is complete, the mechanical assembly connection device is adjustable to a second configuration such that the linear LED light housing module and the second linear LED light housing module are abutted and mechanically attached together.

6. The lighting system of claim 1, wherein the mechanical assembly connection device is removable.

7. The lighting system of claim 1, further comprising an optic facility, wherein the LEDs are arranged in a linear configuration generally following a linear nature of the linear LED light housing, the optic facility being user removable and replaceable, and configured to secure individual optics in relation to each of the LEDs.

8. The lighting system of claim 1, further comprising an LED dimmer function, wherein the linear LED lighting system is adapted to connect to and be dimmed by a conventional external AC dimmer.

9. The modular linear LED lighting system of claim 1, wherein the linear LED light housing module includes a first compartment for LED driver electronics and a second compartment for LEDs; and wherein each of the first and second compartments provides a separate mounting surface; and wherein the first compartment provides heat sinking for the LED driver electronics; and wherein the second compartment provides heat sinking for the LEDs being separate from the heat sinking for the LED driver electronics.

10. The modular linear LED lighting system of claim 1, having a linear series internal electrical interconnect being within the linear LED light housing module, wherein the linear LED light housing module has a quick connect electrical connection in the at least one open side end mounted for electrically connecting the second linear LED light housing module with a matching open end.

11. The lighting system of claim 1, wherein the linear series internal mechanical attachment comprises an internal joining bracket and a front joining bracket, the internal joining bracket and the front joining bracket adapted to be joined by an angled set screw.

12. The lighting system of claim 11, wherein the front joining bracket is adjacent to the compartment for the LEDs.

13. The lighting system of claim 11, wherein the front joining bracket comprises a flange adapted for inserting the mechanical assembly connection device for tightening together the linear LED light housing module and the second linear LED light housing module.

14. The lighting system of claim 11, wherein the internal joining bracket is adjacent to an external wall of the linear LED light housing module.

15. A modular linear LED lighting system, comprising:

a linear LED light housing module;

two linear series internal mechanical attachments within the linear LED light housing module, each attachment comprising an internal joining bracket and a front joining bracket, the internal joining bracket and the front joining bracket adapted to be joined by an angled set screw, wherein the linear LED light housing module is configured with at least one open side end exposing a mechanical attachment point while isolating a user from internal electronics for abutting and mechanically securing a second linear LED light housing module to form an extended length linear LED light housing modular assembly; and a mechanical assembly connection device to hold the linear LED light housing module and the second linear LED light housing module together during assembly of the extended length linear LED light housing modular assembly, such that when the mechanical assembly connection device is in place in a first configuration between the two housing modules there is a space between the two housing modules to facilitate electrical interconnection while maintaining a structurally rigid temporary assembly.

16. The modular linear LED lighting system of claim 15, wherein the linear LED light housing module is configured with removable and replaceable mounting attachments on at least two sides of the housing for mounting the linear LED light housing module.

17. The lighting system of claim 16, wherein the mounting attachments facilitate a wall mounting.

18. The lighting system of claim 16, wherein the mounting attachments facilitate a suspended attachment to a ceiling.

19. The modular linear LED lighting system of claim 15, wherein the linear LED light housing module includes a first compartment for LED driver electronics and a second compartment for LEDs; and wherein each of the first and second compartments provides a separate mounting surface; and wherein the first compartment provides heat sinking for the LED driver electronics; and wherein the second compartment provides heat sinking for the LEDs being separate from the heat sinking for the LED driver electronics.

20. The modular linear LED lighting system of claim 15, having a linear series internal electrical interconnect being within the linear LED light housing module, wherein the linear LED light housing module has a quick connect electrical connection in the at least one open side end mounted for electrically connecting the second linear LED light housing module with a matching open end.

21. The lighting system of claim 15, wherein once the electrical interconnection is complete, the mechanical assembly connection device is adjustable to a second configuration such that the linear LED light housing module and the second linear LED light housing module are abutted and mechanically attached together.

22. The lighting system of claim 15, wherein the mechanical assembly connection device is removable.

23. The lighting system of claim 15, further comprising an optic facility, wherein the LEDs are arranged in a linear configuration generally following a linear nature of the linear LED light housing, the optic facility being user removable and replaceable, and configured to secure individual optics in relation to each of the LEDs.

24. The lighting system of claim 15, further comprising an LED dimmer function, wherein the linear LED lighting system is adapted to connect to and be dimmed by a conventional external AC dimmer.

25. The lighting system of claim 15, wherein each of the front joining brackets is adjacent to the compartment for the LEDs.

26. The lighting system of claim 15, wherein each of the front joining brackets comprises a flange adapted for inserting the mechanical assembly connection device for tightening together the linear LED light housing module and the second linear LED light housing module.

27. The lighting system of claim 15, wherein each of the internal joining brackets is adjacent to an external wall of the linear LED light housing module.

* * * * *